US005379542A

United States Patent [19]

Guzman

[11] Patent Number: 5,379,542

[45] Date of Patent: Jan. 10, 1995

[54] HANDGUN CLEANING TOOL KIT

[76] Inventor: Arsenio F. Guzman, 231 S. Brighton St., Burbank, Calif. 91506

[21] Appl. No.: 99,529

[22] Filed: Jul. 30, 1993

[51] Int. Cl.[6] ..... F41A 29/02

[52] U.S. Cl. ..... 42/95; 7/158; 30/123.3; 30/169; 401/9

[58] Field of Search ..... 7/158, 170; 15/236.05; 30/123.3, 164.5, 169; 42/90, 95, 106; 401/9

[56] References Cited

U.S. PATENT DOCUMENTS

| | | | |
|---|---|---|---|
| 148,687 | 3/1874 | Funk | 7/158 |
| 464,843 | 12/1891 | Bagger | 401/9 |
| 690,116 | 12/1901 | Muller | 30/169 |
| 1,480,053 | 1/1924 | Ericsson | 30/169 |
| 1,488,648 | 4/1924 | Redington | 30/169 |
| 3,526,219 | 9/1970 | Balamuth | 30/123.3 |

FOREIGN PATENT DOCUMENTS

| | | | |
|---|---|---|---|
| 301032 | 1/1930 | United Kingdom | 30/123.3 |

*Primary Examiner*—Stephen C. Bentley
*Attorney, Agent, or Firm*—E. Michael Combes

[57] ABSTRACT

An elongate tubular handle having a knurled exterior wall is arranged to include one of a plurality of tools, to include a pick as well as a plurality of scraping tools to permit access to various remote portions of a handgun during a cleaning procedure.

5 Claims, 4 Drawing Sheets

HANDGUN CLEANING TOOL KIT

BACKGROUND OF THE INVENTION

1. Field of the Invention

The field of invention relates to cleaning apparatus, and more particularly pertains to a new and improved handgun cleaning tool kit wherein the same is arranged to permit employment of a plurality of cleaning heads relative to an elongate handle for scraping various remote regions within a handgun.

2. Description of the Prior Art

Scraping structure is indicated in the prior art such as U.S. Pat. Nos. 4,115,892; 4,558,517; 5,001,796; 5,009,009; and 5,058,274.

Scraping tool structure in the prior art is employed relative to specialized workpieces and in this respect, the present invention is directed to the cleaning of remote portions of a handgun requiring pick as well as plate scraping configurations and in this respect, the present invention substantially fulfills this need.

SUMMARY OF THE INVENTION

In view of the foregoing disadvantages inherent in the known types of scraping apparatus now present in the prier art, the present invention provides a handgun cleaning tool kit wherein the same is arranged to permit selective mounting of one of a plurality of scraping heads relative to an elongate tubular handle for access to remote regions of a firearm for cleaning thereof. As such, the general purpose of the present invention, which will be described subsequently in greater detail, is to provide a new and improved handgun cleaning tool kit which has all the advantages of the prior art cleaning apparatus and none of the disadvantages.

To attain this, the present invention provides an elongate tubular handle having a knurled exterior wall arranged to include one of a plurality of tools, to include a pick as well as a plurality of scraping tools to permit access to various remote portions of a handgun during a cleaning procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved handgun cleaning tool kit which has all the advantages of the prior art cleaning apparatus and none of the disadvantages.

It is another object of the present invention to provide a new and improved handgun cleaning tool kit which may be easily and efficiently manufactured and marketed.

It is a further object of the present invention to provide a new and improved handgun cleaning tool kit which is of a durable and reliable construction.

An even further object of the present invention is to provide a new and improved handgun cleaning tool kit which is susceptible of a low cost of manufacture with regard to both materials and labor, and which accordingly is then susceptible of low prices of sale to the consuming public, thereby making such handgun cleaning tool kits economically available to the buying public.

Still yet another object of the present invention is to provide a new and improved handgun cleaning tool kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
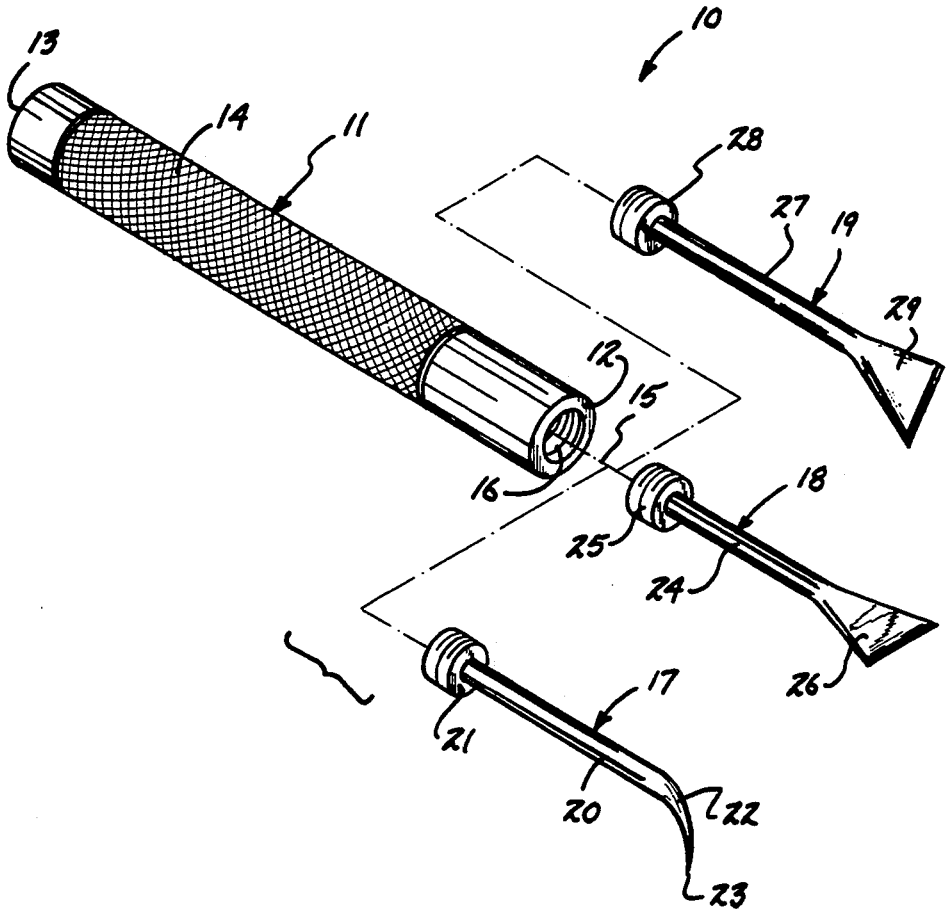
FIG. 1 is an isometric illustration of the invention.

With reference now to the drawings, and in particular to FIGS. 1 to 9 thereof, a new and improved handgun cleaning tool kit embodying the principles and concepts of the present invention and generally designated by the reference numerals 10 and 10*a* will be described.

Figure 2:
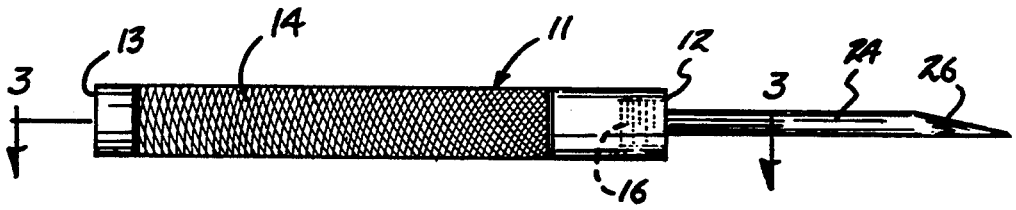
FIG. 2 is an orthographic side view of the invention.
Figure 3:
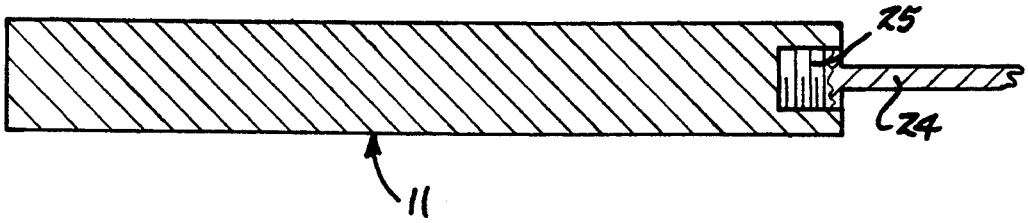
FIG. 3 is an orthographic view, taken along the lines 3—3 of FIG. 2 in the direction indicated by the arrows.

More specifically, the handgun cleaning tool kit 10 of the instant invention essentially comprises an elongate tubular handle 11, having a handle first end 12 spaced from a handle second end 13. A knurled exterior wall portion 14 is directed to the exterior surface of the tubular handle 11 to accommodate ease of grasping of the apparatus during use, wherein the handle as indicated is coaxially aligned along a handle axis 15, with an internally threaded socket 16 symmetrically directed into the first end 12 along the axis 15. Respective first, second, and third tools 17, 18, and 19 are provided, with the first tool having a first tool shank 20, including a first tool threaded boss 21 arranged for threaded reception within the socket 16, and a pick member 22 having a pick member tip 23 extending from the first tool shank 20, with the tip 23 oriented substantially at an oblique angular orientation relative to the shank 20. The second tool 18 includes a second tool shank 24 having a second tool threaded boss 25, and a second scraping plate 26, with the third tool 19 having a third tool shank 27 and a third tool threaded boss 28, and a third tool scraping plate 29. The second and third scraping plates 26 and 29 respectively are oriented at respective first and second angular orientations relative to the respective second and third shanks 24 and 27 to access various portions within a firearm, with the second and third threaded bosses 25 and 28 respectively directed into selective securement with the socket 16, in a manner as indicated in FIGS. 1-3.

Figure 4:
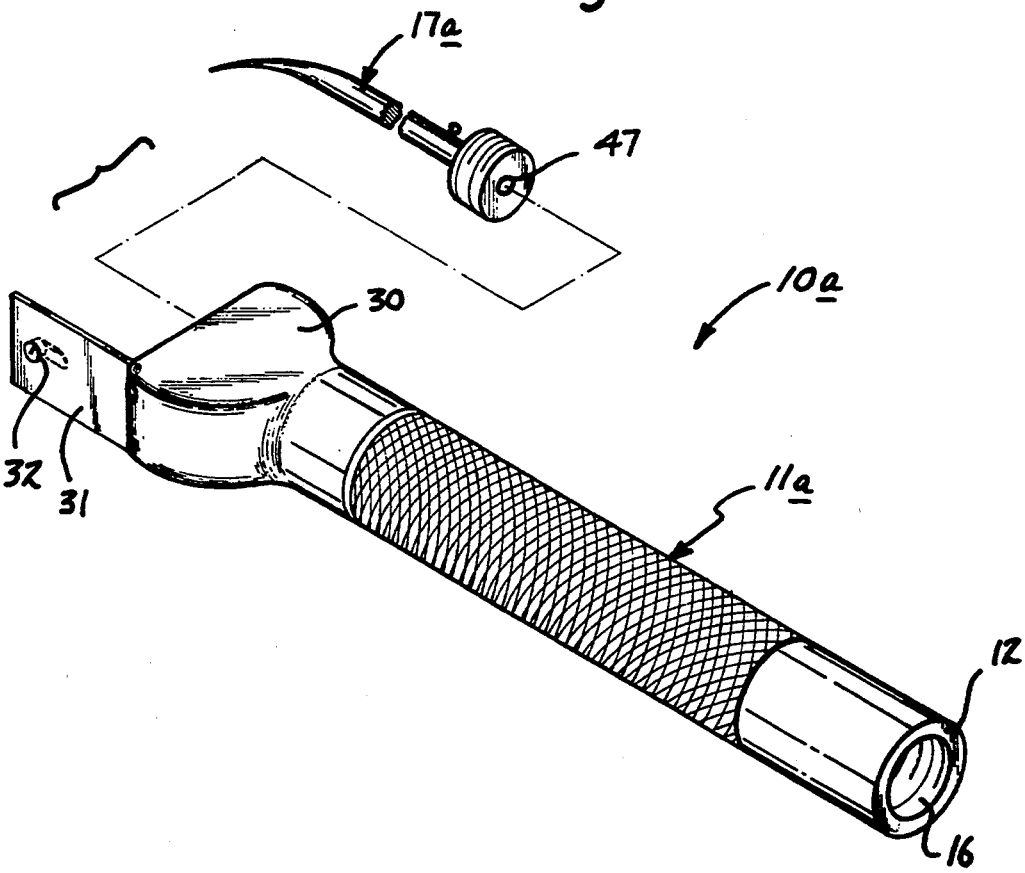
FIG. 4 is an isometric illustration of a modified tool structure as employed by the invention.
Figure 5:
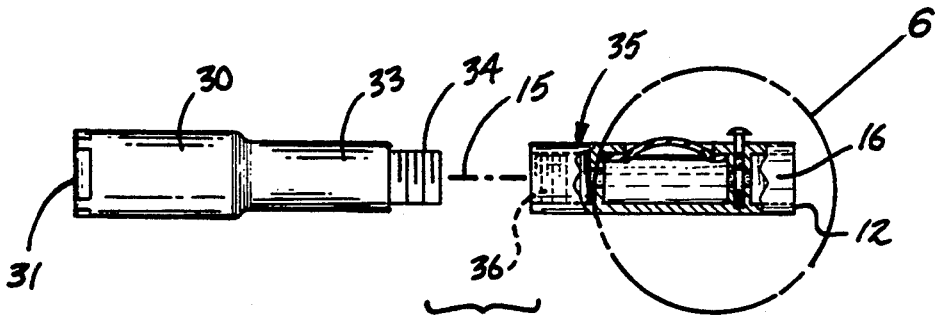
FIG. 5 is an isometric illustration of the modified handle structure in a separated configuration.

The FIG. 4 indicates a modified apparatus 10*a*, to include a modified first tool 17*a*. The apparatus 10*a* includes the modified handle 11*a*, including a second end storage housing 30 integral with the handle second end 13, with the housing 30 having a door plate 31 hingedly mounted to the housing, and a latch 32 for storage of the tool components therewithin in an exemplary manner, as indicated in FIG. 4, such that the housing 30 and its associated cavity is configured to receive the tool members.

The modified handle 11*a* includes a handle first end tubular portion 33 that includes the housing 30 at a first end of the first tubular portion 33, with the second end of the tubular portion including a threaded plug 34 that is coaxially aligned along the axis 15 and arranged for reception within a second tubular portion 35 of the handle 11*a*, wherein the second tubular portion 35 includes an internally threaded receiving bore 36 for threaded reception of the threaded plug 34 for securing the first tubular portion 33 to the second tubular portion 35. The forwardmost end of the second tubular portion includes the internally threaded socket 16 directed into the handle first end 12.

Figure 6:
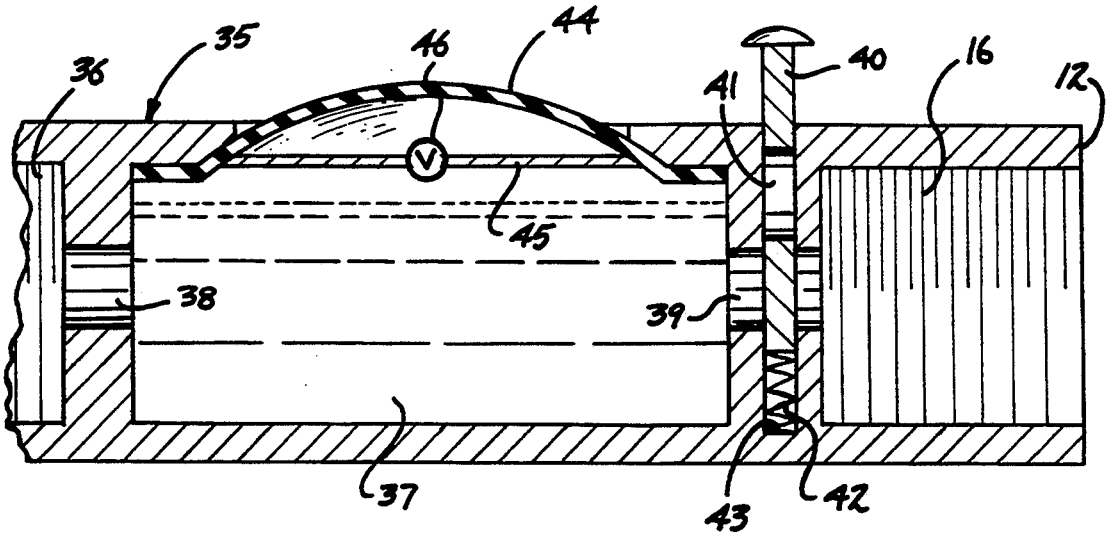
FIG. 6 is an enlarged orthographic view of section 6 as set forth in FIG. 5.
Figure 7:
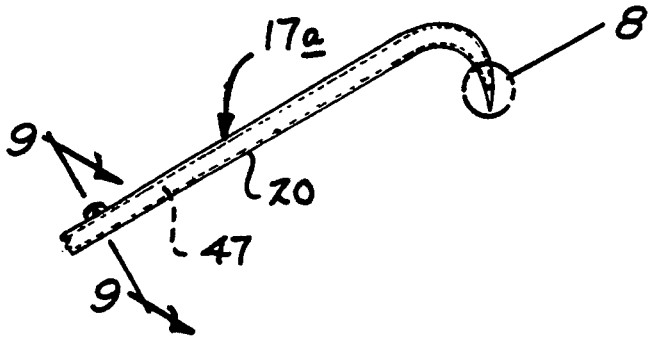
FIG. 7 is an isometric illustration of the modified first tool member as employed by the invention.
Figure 8:
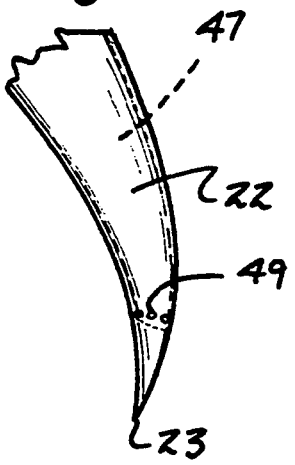
FIG. 8 is an enlarged orthographic view of section 8 as set forth in FIG. 7.
Figure 9:
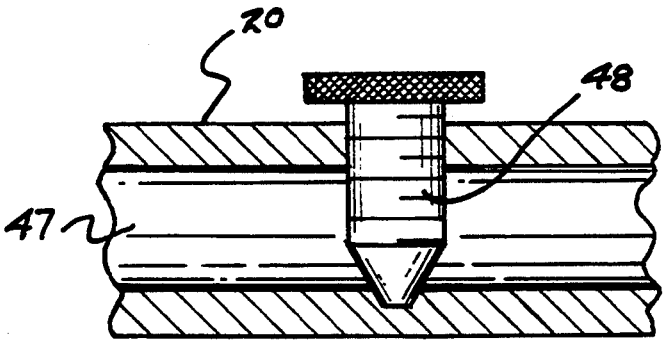
FIG. 9 is an orthographic cross-sectional illustration, taken along the lines 9—9 of FIG. 7 in the direction indicated by the arrows.

With reference to FIG. 6, the second tubular portion 35 includes a fluid reservoir 37 having a first connecting conduit 38 in fluid communication with the internally threaded receiving bore 36, whereupon removal of the first tubular portion 33 relative to the second tubular portion 35, replenishment of a carbon dissolving solvent within the fluid reservoir 37 is provided through the first connecting conduit 38. A second connecting conduit 39 is in fluid communication with the fluid reservoir 37 and the internally threaded socket 16, wherein a gate valve plate 40 is reciprocatably mounted orthogonally relative to the axis 15 in a gate valve cavity, having a cavity floor 43, with a spring 42 interposed between the cavity floor 43 and the gate valve plate 40. The gate valve plate 40 includes an opening 41 that is biased and in a displaced orientation relative to the second connecting conduit 39 in a first position, and is arranged for deflection against the spring 42 for alignment with the second connecting conduit 39 in the second position to permit fluid flow into the socket 16. A resilient plunger 44 is mounted to the second tubular portion 35 in communication with the reservoir 37 through a check valve 46 mounted within a reservoir wall 45, with the check valve 46 interposed between the reservoir 37 and the plunger 44. A modified first tool 17a is indicated for use in the FIGS. 4, 7, 8, and 9, having a first tool shank conduit 47 directed through the first tool shank and the first tool threaded boss 21 for fluid communication with the second connecting conduit 39. A valve rod 48 threadedly directed into the first tool shank conduit 47 through the first tool shank 20 permits selective fluid flow through the first tool shank conduit 47 to permit fluid flow of the aforenoted solvent into the pick member 22 to direct the carbon dissolving fluid through an annular array of fluid outlet ports 49 mounted within the pick member 22 in a spaced orientation relative to the tip 23 to permit selective directing of fluid in a cleaning procedure relative to a firearm. In use, it is understood that the plunger 44 is depressed, either in simultaneous or sequential cooperation with directing the gate valve plate into the second position to permit fluid flow through the second connecting conduit 39 and the associated first tool shank conduit 47.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A handgun cleaning tool kit, comprising, an elongate tubular handle, having a handle first end and a handle second end, with the handle including a knurled exterior wall surface oriented between the handle first end and the handle second end, and the handle symmetrically oriented about a handle axis, and an internally threaded socket directed into the handle first end, and a plurality of tools, including a first tool having a first tool threaded boss arranged for selective reception within the socket, and a first tool shank integrally directed from the first tool threaded boss, and a pick member having a pick member tip, with the pick member oriented at an oblique angular orientation relative to the first tool shank, and the tool members including at least a second tool, having a second tool scraping plate mounted to a second tool shank, wherein the second tool shank includes a second tool threaded boss arranged for reception within the socket, a storage housing mounted integrally to the second end, with the storage housing including a door plate hingedly mounted to the storage housing for reception of at least one of said tool members therewithin.

2. A tool kit as set forth in claim 1 wherein the handle includes a first tubular portion separably mounted relative to a second tubular portion, with the first tubular portion including the storage housing, and a threaded plug integrally mounted to the first tubular portion spaced from the storage housing, and the second tubular portion including a second tubular portion internally threaded bore spaced from the socket, with the internally threaded bore arranged for receiving the threaded plug therewithin, wherein the first tubular portion and the second tubular portion are coaxially aligned along a predetermined axis.

3. A tool kit as set forth in claim 2 wherein the second tubular portion includes a fluid reservoir oriented between the internally threaded receiving bore and the socket, with a first connecting conduit arranged in fluid communication between the fluid reservoir and the internally threaded receiving bore to permit replenishment of fluid within the fluid reservoir through the first connecting conduit, and a second connecting conduit arranged in fluid communication between the fluid reservoir and the socket, and a gate valve plate reciprocatably mounted through the second connecting conduit, and a gate valve plate cavity arranged for receiving the gate valve plate, and the gate valve plate arranged to include a cavity floor mounted within the gate valve plate cavity, with a spring interposed between the cavity floor and the gate valve plate, the gate valve plate having an opening directed through the gate valve plate, wherein the opening is displaced relative to the second connecting conduit in the first position, and the opening is arranged for alignment with the second connecting conduit in a second depressed position of the gate valve plate.

4. A tool kit as set forth in claim 3 wherein the second tubular portion includes a resilient plunger and a reservoir wall interposed between the plunger and the reservoir, and a check valve interposed within the reservoir wall, whereupon compressing of the plunger against the reservoir wall effects pressurizing of the fluid reservoir to direct fluid through the second connecting conduit and the gate valve plate opening.

5. A tool kit as set forth in claim 4 wherein the first tool shank includes a first tool shank conduit extending through the first tool shank and through the first tool threaded boss for fluid communication with the second connecting conduit when the second tool shank is received within the socket, and the first tool shank conduit including a valve member mounted within the first tool shank conduit to permit selective fluid flow through the first tool shank conduit, and the pick member having an annular array of fluid outlet ports in fluid communication with the first tool shank conduit, with the annular array of fluid outlet ports arranged in a spaced orientation relative to the tip of the first tool.

* * * * *